US011274020B2

(12) United States Patent
Seki et al.

(10) Patent No.: US 11,274,020 B2
(45) Date of Patent: Mar. 15, 2022

(54) DOOR OPERATION CONTROLLER

(71) Applicant: Otis Elevator Company, Farmington, CT (US)

(72) Inventors: Hisanori Seki, Tomisato (JP); Atsushi Yamada, Narita (JP); Tomomitsu Sano, Chiba-Ken (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 1100 days.

(21) Appl. No.: 15/869,796

(22) Filed: Jan. 12, 2018

(65) Prior Publication Data

US 2019/0218068 A1 Jul. 18, 2019

(51) Int. Cl.
*B66B 13/14* (2006.01)
*B66B 13/26* (2006.01)

(52) U.S. Cl.
CPC ..... *B66B 13/146* (2013.01); *B66B 13/26* (2013.01)

(58) Field of Classification Search
CPC ..... B66B 13/146; B66B 13/26
USPC ..... 187/247
See application file for complete search history.

(56) References Cited

U.S. PATENT DOCUMENTS 3,367,450 A 2/1968 Lester et al.
4,029,176 A 6/1977 Mills
4,112,419 A 9/1978 Kinoshita et al.
RE30,719 E 8/1981 Mills
4,797,675 A 1/1989 Ovaska
4,870,663 A 9/1989 Kulju et al.
4,874,063 A * 10/1989 Taylor ..... B66B 5/0006 187/391
5,583,405 A * 12/1996 Sai ..... G01S 15/876 318/286
6,970,085 B2 * 11/2005 Okabe ..... E05F 15/74 340/545.6
7,151,350 B2 12/2006 Haag et al.
8,904,708 B2 * 12/2014 Zacchio ..... E05F 15/43 49/25
9,341,013 B2 * 5/2016 Iwata ..... E05F 15/73
2009/0236185 A1 * 9/2009 Yumura ..... B66B 13/26 187/317
2011/0056134 A1 * 3/2011 Zacchio ..... E05F 15/73 49/31
2018/0096576 A1 * 4/2018 Anderholm ..... G01S 13/886

FOREIGN PATENT DOCUMENTS

CN 101304939 A 11/2008
CN 103287952 A 9/2013
CN 103663068 A 3/2014
CN 102037204 B 8/2014
CN 105668392 A 6/2016
CN 205397808 U 7/2016
(Continued)

*Primary Examiner* — Jeffrey Donels
(74) *Attorney, Agent, or Firm* — Cantor Colburn LLP

(57) ABSTRACT

A door operation controller for an elevator includes at least one sensor arranged in a doorway at a landing for detecting moving direction and/or moving speed of a person or an object in or near the doorway during a time period from when the elevator door is opened until when the elevator door is closed at the landing. The controller is configured to control door operation in response to the detection of a person's or object's movement in or near the doorway at the landing.

17 Claims, 6 Drawing Sheets

(56) References Cited

FOREIGN PATENT DOCUMENTS

| | | | |
|---|---|---|---|
| CN | 106946109 | A | 7/2017 |
| CN | 107522045 | A | 12/2017 |
| DE | 10260109 | A1 | 7/2004 |
| GB | 1109005 | A | 4/1968 |
| JP | S5488543 | A | 7/1979 |
| JP | S54155551 | A | 12/1979 |
| JP | H061573 | A | 1/1994 |
| JP | 2008050138 | A | 3/2008 |

* cited by examiner

DOOR OPERATION CONTROLLER

TECHNICAL FIELD

The present invention relates generally to a door operation controller for elevators. More specifically, the present invention relates to a door operation controller and its controlling method for optimizing elevator service time.

BACKGROUND ART

Various elevator devices have been proposed for preventing persons or objects from being caught by an elevator door. One example is to use a safety shoe formed of a metal strip that is arranged at the closing side edge of the door and connected by means of pivot arms which allow its movement relative to the door opening direction. When a passenger or an object is caught by the door during close movement of the door, the safety shoe is pushed against the door opening direction to detect the presence of the passenger or object, thereby moving the door toward an open position.

Another example is to use a sensor such as an infrared sensor, an ultrasonic sensor, etc. arranged across the doorway in order to improve the detection of persons or objects within the field of doorway. When such sensor detects the presence of a passenger moving across the doorway while the elevator door is closing, the door will stop and then move in a reverse direction to avoid the passenger being caught by the door.

However, due to the limitation of detection range of such sensors, it may be possible for the sensors to fail detection of a passenger even though the passenger is moving across the doorway during close movement of the door, which may cause the passenger to be caught by the door.

Furthermore, in a case where a person is approaching the elevator entrance with slow steps, it may still be possible that the door will be closed regardless of the presence of the passenger approaching the elevator car.

Another drawback of such sensors is that they are sensitive to dust, noise or light sources that can interfere with proper operation.

Accordingly, it would be desirable to provide an improved door controller for an elevator that can detect a person or an object located in or near the doorway to stop and re-open the elevator door.

It would also be desirable to provide an improved arrangement for detecting a person or an object moving toward or away from the elevator doorway in order to eliminate unwanted door re-opening and optimize the elevator service time.

SUMMARY OF INVENTION

According to one aspect of the present invention, a door operation controller for an elevator is disclosed. The door operation controller includes at least one sensor arranged in a doorway at a landing for detecting moving direction and/or moving speed of a person or an object in or near the doorway during a time period from when the elevator door is opened until when the elevator door is closed at the landing. The controller is configured to control door operation in response to the detection of a person's or object's movement in or near the doorway at the landing.

In some embodiments, the controller is configured to evaluate a congestion state at the landing to extend door opening time.

In some embodiments, the congestion state is evaluated based on the detection of a person moving away from the doorway at a speed below a first threshold speed.

In some embodiments, the congestion state is evaluated based on the number of people moving at a speed below the first threshold speed.

In some embodiments, the controller is configured to keep the elevator door in an open state when a person is approaching the doorway.

In some embodiments, the controller generates an alarm or an audible message to the approaching person exceeding the second threshold speed to call an attention.

In some embodiments, the at least one sensor comprises at least one Doppler sensor.

In some embodiments, the at least one Doppler sensor is arranged in the leading edge of a safety shoe that is arranged near the door closing side edge of a car door, and the door operation controller is arranged in an elevator car.

In some embodiments, the at least one Doppler sensor is angled toward the landing so that the detection range of the Doppler sensor extends in both the doorway and the landing.

In some embodiments, the detection range of the Doppler sensor is 5 to 10 meters with maximum horizontal angle of 180 degrees.

In some embodiments, the at least one Doppler sensor includes a pair of Doppler sensors arranged on either side of the doorway.

According to another aspect of the present invention, a method of controlling door operation for an elevator is disclosed. The method includes opening an elevator door upon arrival of an elevator car at a landing; detecting moving direction and/or moving speed of a person or an object in and near a doorway at the landing; counting a first door opening time during which there is no person or object moving in or near the doorway; extending the first door opening time in response to the detection of a person moving away from the doorway at a speed below a first threshold speed; keeping the elevator door in an open state in response to the detection of a person moving toward the doorway; and closing the elevator door when the first door opening time has passed.

In some embodiments, the method of controlling door operation for an elevator further includes reopening the elevator door in response to the detection of a person moving across the doorway during close movement of the elevator door; counting a second door opening time during which there is no person or object moving in or near the doorway after reopening the elevator door, the second door opening time being shorter than the first door opening time; and closing the elevator door when the second opening time has passed.

In some embodiments, the method further includes generating an alarm or an audible message to the approaching person exceeding the second threshold speed to call an attention.

In some embodiments, the moving direction and moving speed of a person or an object in and near the doorway is detected by at least one Doppler sensor arranged in the doorway.

In some embodiments, the at least one Doppler sensor is arranged in the leading edge of a safety shoe that is arranged near the door closing side edge of a car door.

In some embodiments, the at least one Doppler sensor is angled toward the landing so that the detection range of the Doppler sensor extends in both the doorway and the landing.

In some embodiments, the at least one Doppler sensor includes a pair of Doppler sensors arranged on either side of the doorway.

These and other aspects of this disclosure will become more readily apparent from the following description and the accompanying drawings, which can be briefly described as follows.

DESCRIPTION OF EMBODIMENTS

Figure 1:
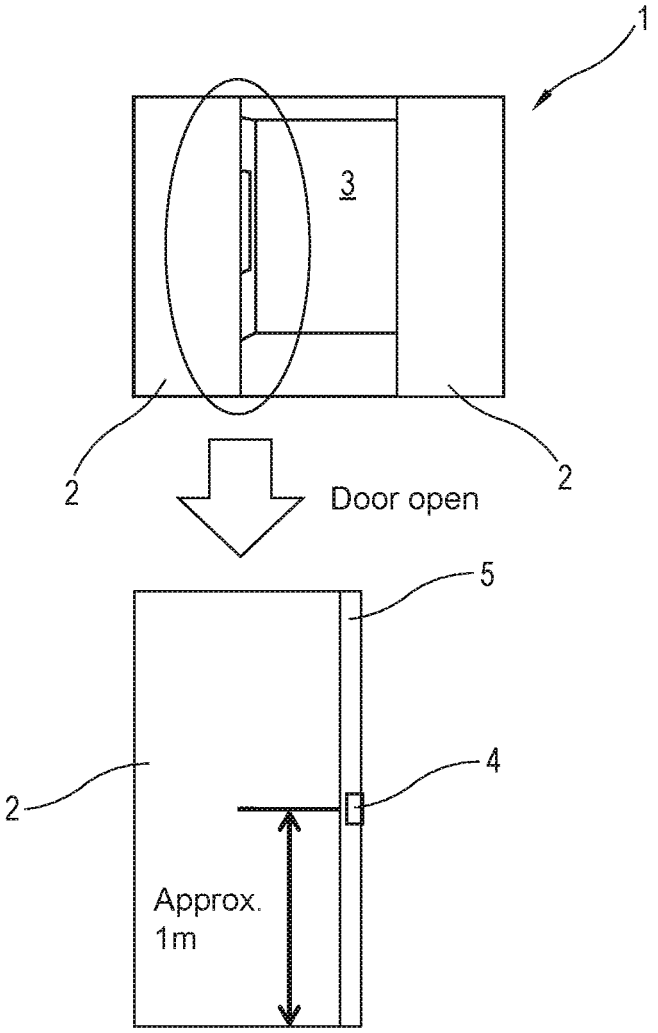
FIG. 1 is a schematic front view showing one possible arrangement of a passenger detection sensor in accordance with the present invention.

FIG. 1 schematically shows a portion of an elevator doorway 1. An elevator door 2 is automatically movable between open and closed positions. In the upper image of FIG. 1, it can be seen that an elevator car 3 arrives at a landing and the elevator door 2 is moving toward the open position. In the illustrated example, a set of elevator doors 2 are moving in opposite direction toward each other and partially hide behind the walls on either side of the doorway 1. Although the present invention will be described with reference to a center opening door with two door panels that meet in the center of the opening, it should be understood that the present invention can be applied to a side opening door that opens to the left or right laterally.

Figure 3:
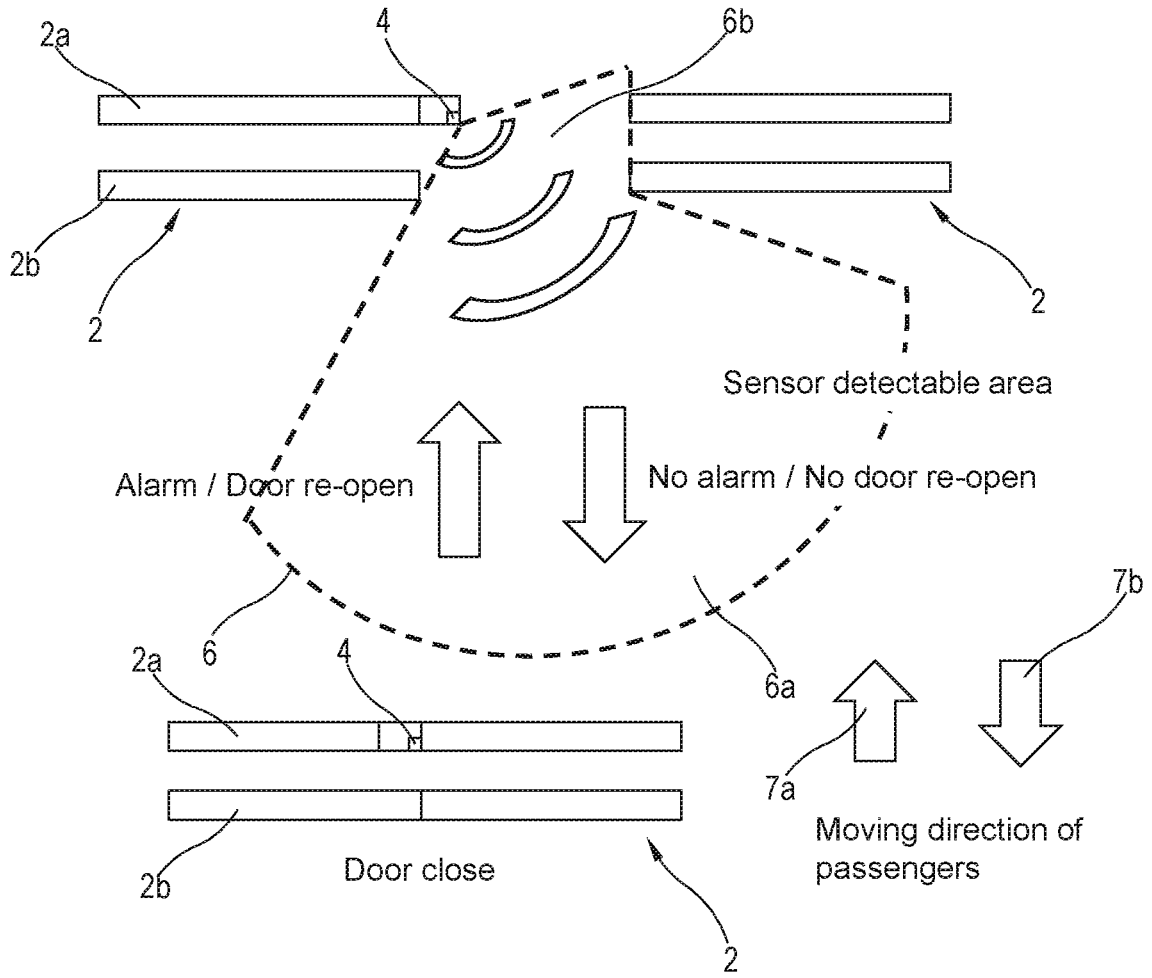
FIG. 3 is a schematic plan view showing an example detection range using a passenger detection sensor in accordance with the present invention.

As can be seen from the top view of the elevator door 2 in FIG. 3, each elevator door 2 consists of a car door 2*a* mounted on the elevator car 3 and a hoistway door 2*b* arranged at the landing to move parallel with the car door 2*a*. When the car door 2*a* is opened and closed on arrival of the elevator car 3 at the landing, the hoistway door 2*b* also moves in the door opening and closing direction in conjunction with the car door 2*a* as is well known in the art.

The lower image of FIG. 1 shows an exemplary arrangement of the passenger detection sensor in accordance with the present invention. In this embodiment, the passenger detection sensor 4 generally consists of at least one Doppler sensor 4 arranged in the leading edge of a safety shoe 5 that is arranged near the door closing side edge of the car door 2*a* in a known manner. In one example, at least one Doppler sensor 4 is located at the height of approximately one meter from the platform.

Figure 2:
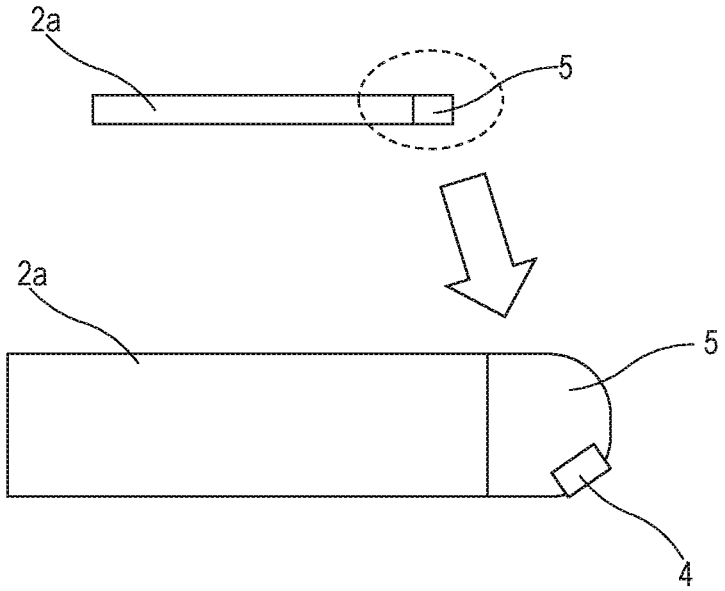
FIG. 2 is a schematic plan view showing one possible arrangement of a passenger detection sensor in accordance with the present invention.

FIG. 2 schematically shows a top view of the car door 2*a* with the Doppler sensor 4 arranged in the safety shoe 5. As can be appreciated from the figure, the Doppler sensor 4 is mounted on the leading edge of the safety shoe 5 and angled toward the landing. It should be understood that the angle of the sensor 4 toward the landing can be adjusted so that the detection range is established in a desired orientation.

FIG. 3 schematically illustrates an exemplary sensor detection range of the Doppler sensor 4 according to an embodiment of this invention. It can be seen that the detection range 6 of the sensor 4 extends in both the landing area 6*a* and the doorway area 6*b*, i.e., the open-close area of the elevator door 2 so that the Doppler sensor 4 can detect the presence of a person moving toward the doorway 1 (as shown by arrow 7*a*) and/or away from the doorway 1 (as shown by arrow 7*b*) at the landing area 6*a* as well as the person moving across the doorway area 6*b*. In one example, the detection range of the Doppler sensor 4 is about 5 to 10 meters with maximum horizontal angle of 180 degrees. However, it should be understood that the detection range and orientation of the Doppler sensor 4 may be adjustable depending on the installation requirements of the elevator such as elevator size, the area of a landing, etc.

One advantage of the use of Doppler sensor 4 is that it can detect moving direction of persons or objects at the landing while detecting those moving across the doorway 1 with a simple device. In particular, a Doppler sensor can identify not only a passenger moving across the doorway to avoid the passenger being caught by the door, but also identify the presence of a person approaching the doorway with slow steps or using a wheelchair to keep the elevator door in an open state. Furthermore, since a Doppler sensor can detect a moving velocity, the door operation controller of the present invention can evaluate the congestion state at a landing based on the walking speed of a person moving away from the doorway 1 to extend door opening time.

Figure 4:
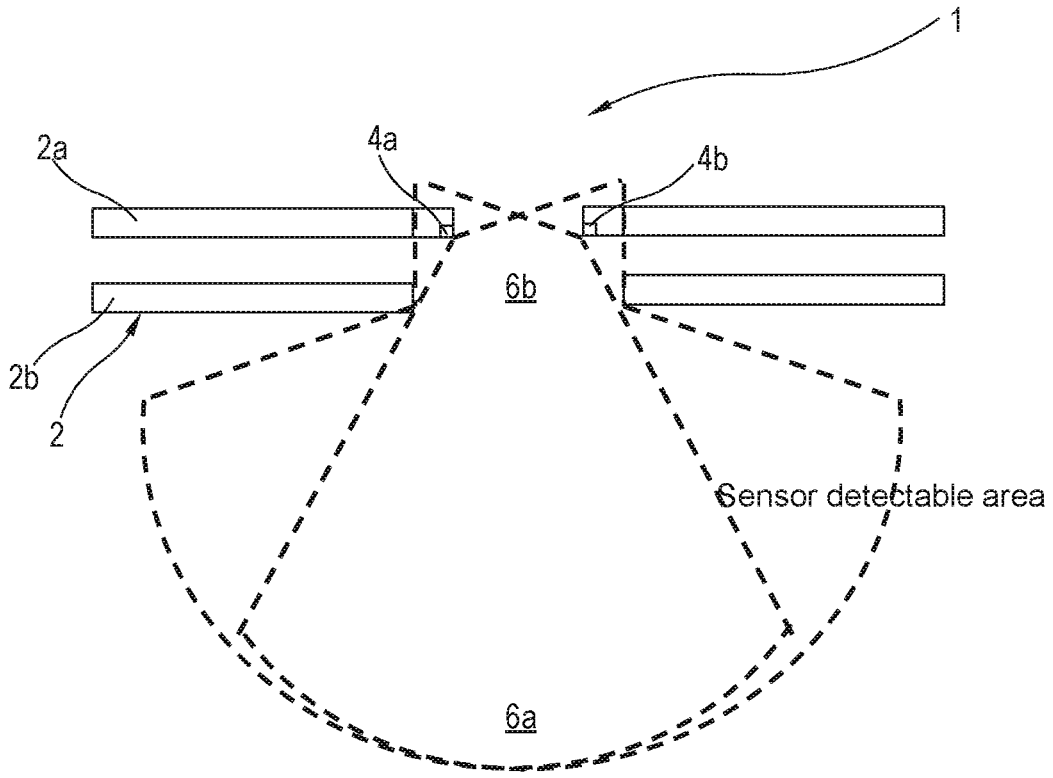
FIG. 4 is a schematic plan view showing another example detection range using a pair of passenger detection sensors in accordance with the present invention.

FIG. 4 schematically shows another example sensor arrangement using two Doppler sensors 4*a* and 4*b*, one on each side of the doorway 1. In this example, each of two Doppler sensors 4*a* and 4*b* is arranged in a respective leading edge of a respective safety shoe 5 arranged near the door closing side edge of the respective car door 2*a*. As shown in FIG. 4, each detection range of the respective sensor 4*a* and 4*b* extends in both the landing area 6*a* and the doorway area 6*b* and the total detection area extends more broadly than the embodiment shown in FIG. 3 so that each Doppler sensor 4*a* and 4*b* can detect the presence of a person moving toward and/or away from the doorway 1 as well as the person moving across the doorway 1 over a wider range. In particular, the detection ranges of the pair of Doppler sensors 6*a* and 6*b* overlap with one another and whereby the position of persons or objects at the landing area 6*a* and at the doorway area 6*b* can be detected. By detecting the position of persons or objects at a landing, the door operation controller of the present invention can evaluate the congestion state at the landing more precisely based on the number of people moving away from the doorway 1 at a slow speed.

Although the present invention is described with reference to at least one Doppler sensor or a pair of Doppler sensors as shown in FIGS. 3 and 4, it should be understood that various sensors at various locations may be alternatively or additionally be provided, as long as the at least one sensor can detect the moving speed and/or moving direction of a person or an object in or near the field of doorway 1.

Figure 5:
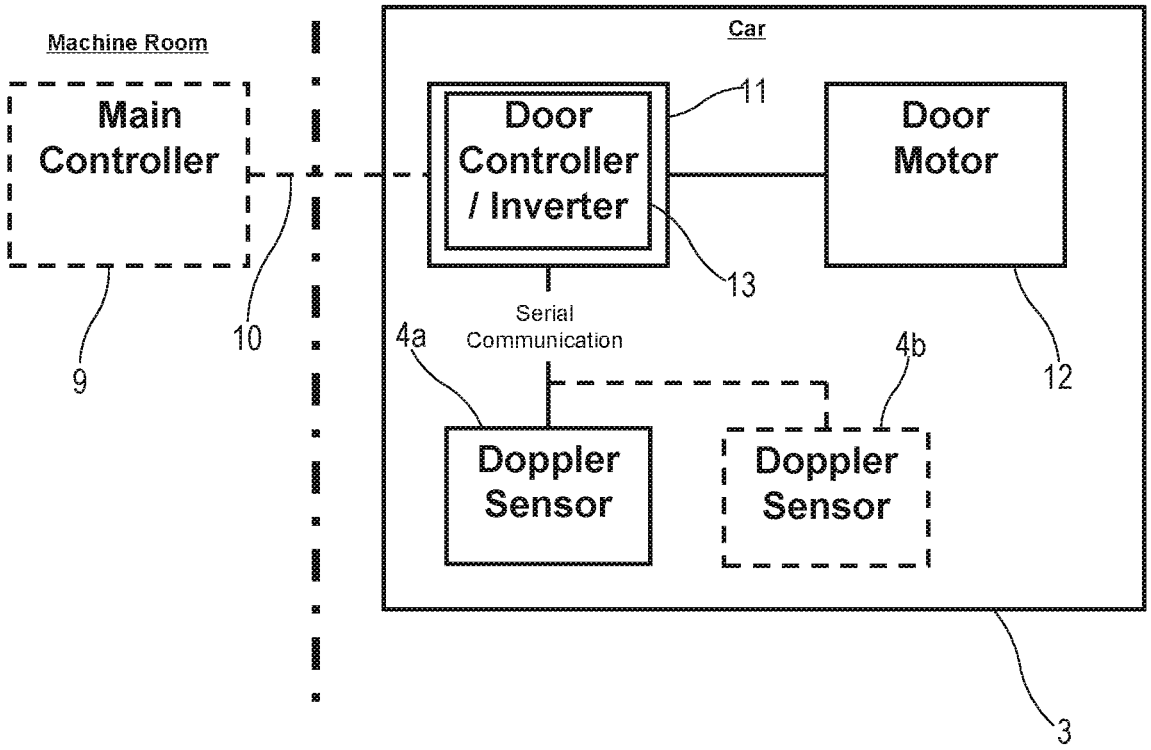
FIG. 5 illustrates a block diagram showing one possible arrangement of components of an elevator system in accordance with the present invention.

Referring now to FIG. 5, an exemplary arrangement of the passenger detection system for an elevator in accordance with the present invention is shown by a block diagram. An elevator system 8 generally includes an elevator car 3 configured to move vertically upward and downward within a hoistway, and a main controller 9 configured to generate a signal to allocate the elevator car 3 when a passenger enters a hall call at a landing. The main controller 9 is generally provided in a machine room above the top floor of a building or provided in an operation control panel arranged at any specific location in a building. The main controller 9 is connected through a traveling cable 10 to a car controller 11 of the elevator car 3 to supply power and transmit/receive operation signals. The car controller 11 is equipped with a door controller 13 for operating the elevator door 2, which is connected to a door motor 12 configured to open and close the elevator door 2 to allow passengers on and off the elevator car 3.

As described above, at least one Doppler sensor 4 is arranged in the leading edge of the safety shoe 5 arranged near the closing side edge of the car door 3. The Doppler sensor 4 is connected to the door controller 13 for detecting the presence of persons or objects moving toward and/or away from the doorway 1 as well as those moving across the doorway 1. Alternatively, a pair of Doppler sensors 4*a* and 4*b* may be arranged in the respective safety shoes 5 on the respective car doors 2*a* of the center opening door. In the illustrated example, two Doppler sensors 4*a* and 4*b* may be connected in parallel with each other with respect to the door controller 13. It should be understood that any number of Doppler sensors 4 at various locations on the car door 2*a* may be alternatively or additionally be provided.

In any case, mounting the Doppler sensor 4 on the elevator car 3 is highly cost-effective, in that such configuration reduces number of sensors and complexity upon installation as compared with a configuration in which multiple sensors are arranged around each of the doorways at the respective landings.

In particular, arranging at least one Doppler sensor 4 in the safety shoe 5 on the car door 2*a* is advantageous in that the door controller 13 of the present invention can reduce response time to the detection of the presence of a person or an object moving across the doorway 1 during door closing operation, because the Doppler sensor 4 is directly connected to the door controller 13 in the car controller 11.

Furthermore, using a Doppler sensor as a sensor for detecting moving direction and moving speed of a person or an object is advantageous in that it enables a reliable detection of the person or object in an outdoor environment since a Doppler sensor is not influenced by dust, noise or light sources.

In addition, since the Doppler sensor 4 according to an embodiment of this invention is integrated in the safety shoe 5 and the door controller 13 is installed in the car controller 11, the door controller 13 of the present invention is retrofittable to existing elevator systems.

In the following, a method of controlling elevator door operation will now be described with reference to FIG. 6.

Figure 6:
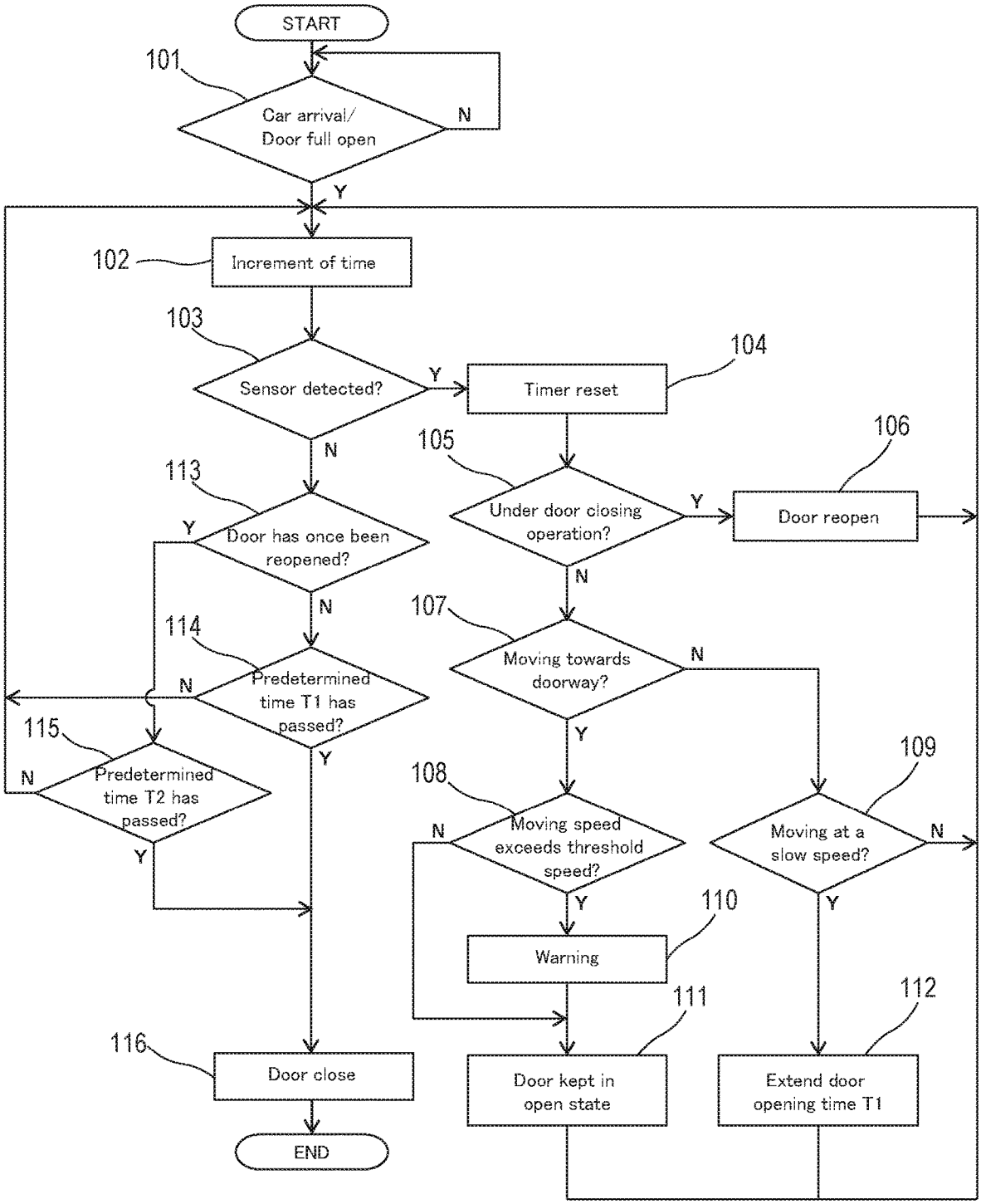
FIG. 6 is a flow diagram of exemplary operations performed by the door operation controller based on the movement of a person in or near an elevator doorway.

FIG. 6 is a flowchart diagram of exemplary operations performed by the door controller 13 based on the movement of a person at a landing. The process begins at step 101 when the elevator door 2 is opened at the landing, followed by the incrementing of time for counting door opening time during which the sensor 4 does not detect the presence of a person or an object moving across, away from, or toward the doorway 1 at step 102, and then proceeding to step 103.

At step 103, a determination is made whether or not the Doppler sensor 4 detects the presence of a person near or in the field of doorway 1 (See FIGS. 3 and 4). If the sensor 4 detects the presence of a person at step 103, flow proceeds to step 104 to reset time for counting door opening time, followed by proceeding to step 105.

At step 105, the controller 13 determines whether the sensor 4 detects the presence of a person across the doorway 1 during close movement (at step 116) of the elevator door 2. If the sensor 4 detects the presence of a person during door closing operation, the door closing operation is immediately stopped and the door 2 is reopened at step 106, followed by returning to step 102 to repeat process. If not, flow proceeds to step 107 where the controller 13 determines whether the person is moving toward the doorway 1.

At step 107, if the person is approaching the doorway 1, flow proceeds to step 108 where the controller 13 determines whether the moving speed of the person exceeds a threshold speed (a first threshold speed). If not, flow proceeds to step 111 to keep the elevator door 2 in an open state, followed by returning to step 102 to repeat process.

On the other hand, at step 108, if the moving speed exceeds the first threshold speed, the controller 13 determines that the person is rushing to get on the elevator 1. The controller 13 immediately generates an alarm or an audible message at step 110 to call an attention, followed by proceeding to step 111 to keep the elevator door in an open state. Once the steps 110 and 111 are performed, flow returns to step 102 to repeat process (steps 103, 104, 105, 107, 108, 110, 111).

Again, at step 107, if the person is not moving toward the doorway 1, i.e., if the person is moving away from the doorway 1, flow proceeds to step 109 where the controller 13 determines whether the person is moving at a slow speed, or at a speed below a second threshold speed. Generally, the second threshold speed is lower than the first threshold speed. If not, i.e., if the person is leaving the elevator car 2 at a normal walking speed, the process returns to step 102 to repeat process (steps 103, 104, 105, 107, 109). If the person is moving at a slow speed (below the second threshold speed) due to the fact that e.g. the passengers are moving with a wheelchair or crutches, or there are many people crowded at the landing, flow proceeds to step 112 to extend door opening time $T_1$, followed by returning to step 102 to repeat process.

Here, as described with reference to FIG. 4, the elevator system 8 may include a pair of Doppler sensors 4*a* and 4*b* arranged on each side of the doorway 1. In such case, at step 109, the door controller 13 can further evaluate the congestion state at a landing more precisely based on the number of people moving at a slow speed to extend door opening time $T_1$.

Referring back to step 103, if there is no person detected in or around the field of doorway 1, flow then proceeds to step 113 to determine whether the door 2 has once been reopened. If not, flow proceeds to step 114 to check whether the first door opening time $T_1$ has passed. If not, flow returns to step 102 to repeat process until the first door opening time $T_1$ has passed. When the first door opening time $T_1$ has passed at step 114, flow proceeds to step 116 to perform door closing operation to end this process.

Again, at step 113, if the door 2 has once been reopened (at step 106) in response to the detection of the presence of a person moving across the doorway 1 during door closing operation, flow proceeds to step 115 to check whether a second door opening time $T_2$ has passed. If not, flow returns to step 102 to repeat process until the second door opening time $T_2$ has passed. When the second door opening time $T_2$ has passed at step 115, flow then proceeds to step 116 to perform door closing operation to end this process. As noted above, if the sensor 4 detects the presence of a person across the doorway 1 during door closing operation at step 116, the door is reopened (steps 105, 106).

It should be noted that the first door opening time $T_1$ is a predetermined time period during which the sensor 4 does not detect the presence of a person or an object moving across, away from, or toward the doorway 1. The first door opening time $T_1$ may be extended for a predetermined amount of time following the execution of step 112. The second door opening time $T_2$ is a time period during which the sensor 4 does not detect the presence of a person or an object after reopening the elevator door 2. The second door opening time $T_2$ is selected to be shorter than the first door opening time $T_1$ ($T_2<T_1$) in order to optimize elevator service time. It should be understood that the first and second door opening times $T_1$ and $T_2$ may be selected based on the installation requirements of the elevator such as elevator size, the area of a landing, traffic flow of passengers in a building, etc.

The present invention is characterized in that the door opening time can be properly controlled based on moving direction and moving speed of a person or an object moving toward or away from the doorway 1 when the elevator car 3 stops at a landing, while monitoring the presence of a person or an object moving across the doorway 1 during door closing operation. With such a configuration, elevator operation performance can be improved without unwanted re-opening of the elevator door 2. Therefore, the door controller 13 of the present invention can provide an improved elevator system without delay in elevator service speed.

While the present invention has been particularly shown and described with reference to the exemplary embodiments as illustrated in the drawings, it will be recognized by those skilled in the art that various modifications may be made without departing from the spirit and scope of the invention as disclosed in the accompanying claims.

What is claimed is:

1. A door operation controller for an elevator, comprising:

at least one sensor arranged in a doorway at a landing for detecting moving direction and/or moving speed of a person or an object in or near the doorway during a time period from when the elevator door is opened until when the elevator door is closed at the landing, wherein the controller is configured to control door operation in response to the detection of a person's or object's movement in or near the doorway at the landing;

wherein the controller is configured to evaluate a congestion state at the landing to extend door opening time.

2. The device of claim 1, wherein the congestion state is evaluated based on the detection of a person moving away from the doorway at a speed below a first threshold speed.

3. The device of claim 2, wherein the congestion state is evaluated based on the number of people moving at a speed below the first threshold speed.

4. The device of claim 1, wherein the controller is configured to keep the elevator door in an open state when a person is approaching the doorway.

5. The device of claim 4, wherein the controller generates an alarm or an audible message to the approaching person exceeding the second threshold speed to call an attention.

6. The device of claim 1, wherein the at least one sensor comprises at least one Doppler sensor.

7. The device of claim 6, wherein the at least one Doppler sensor is arranged in the leading edge of a safety shoe that is arranged near the door closing side edge of a car door, and the door operation controller is arranged in an elevator car.

8. The device of claim 7, wherein the at least one Doppler sensor is angled toward the landing so that the detection range of the Doppler sensor extends in both the doorway and the landing.

9. A door operation controller for an elevator, comprising:

at least one sensor arranged in a doorway at a landing for detecting moving direction and/or moving speed of a person or an object in or near the doorway during a time period from when the elevator door is opened until when the elevator door is closed at the landing;

wherein the controller is configured to control door operation in response to the detection of a person's or object's movement in or near the doorway at the landing wherein the at least one sensor comprises at least one Doppler sensor;

wherein the at least one Doppler sensor is arranged in the leading edge of a safety shoe that is arranged near the door closing side edge of a car door, and the door operation controller is arranged in an elevator car;

wherein the at least one Doppler sensor is angled toward the landing so that the detection range of the Doppler sensor extends in both the doorway and the landing;

wherein the detection range of the Doppler sensor is 5 to 10 meters with maximum horizontal angle of 180 degrees.

10. The device of claim 6, wherein the at least one Doppler sensor includes a pair of Doppler sensors arranged on either side of the doorway.

11. A method of controlling door operation for an elevator, the method comprising:

opening an elevator door upon arrival of an elevator car at a landing;

detecting moving direction and/or moving speed of a person or an object in and near a doorway at the landing;

counting a first door opening time during which there is no person or object moving in or near the doorway;

extending the first door opening time in response to the detection of a person moving away from the doorway at a speed below a first threshold speed;

keeping the elevator door in an open state in response to the detection of a person moving toward the doorway; and closing the elevator door when the first door opening time has passed.

12. The method of claim 11, further comprising:

reopening the elevator door in response to the detection of a person moving across the doorway during close movement of the elevator door;

counting a second door opening time during which there is no person or object moving in or near the doorway after reopening the elevator door, the second door opening time being shorter than the first door opening time; and closing the elevator door when the second opening time has passed.

13. The method of claim 11, further comprising:

generating an alarm or an audible message to the approaching person exceeding the second threshold speed to call an attention.

14. The method of claim 11, wherein the moving direction and moving speed of a person or an object in and near the doorway is detected by at least one Doppler sensor arranged in the doorway.

15. The method of claim 14, wherein the at least one Doppler sensor is arranged in the leading edge of a safety shoe that is arranged near the door closing side edge of a car door.

16. The method of claim 15, wherein the at least one Doppler sensor is angled toward the landing so that the detection range of the Doppler sensor extends in both the doorway and the landing.

17. The method of claim 14, wherein the at least one Doppler sensor includes a pair of Doppler sensors arranged on either side of the doorway.

* * * * *